US006877496B2

(12) United States Patent
Todoroki

(10) Patent No.: US 6,877,496 B2
(45) Date of Patent: Apr. 12, 2005

(54) IGNITION DEVICE FOR IMPROVING IGNITION SPARK INTENSITY FOR A PLUG CORD FOR AN INTERNAL COMBUSTION ENGINE AND DIRECT IGNITION SYSTEM FOR AN INTERNAL COMBUSTION ENGINE, AND METHOD FOR CONNECTING THE SAME

(75) Inventor: Hideaki Todoroki, 4613-4 Funatsu, Kawaguchiko-machi, Minamitsuru-gun, Yamanashi Prefecture (JP)

(73) Assignees: Hideaki Todoroki, Yamanashi Prefecture (JP); E Image Technology K.K., Yamanashi Prefecture (JP)

( * ) Notice: Subject to any disclaimer, the term of this patent is extended or adjusted under 35 U.S.C. 154(b) by 0 days.

(21) Appl. No.: 10/659,780

(22) Filed: Aug. 27, 2003

(65) Prior Publication Data

US 2004/0084033 A1 May 6, 2004

(30) Foreign Application Priority Data

Aug. 28, 2002 (JP) ..... 2002-291702

(51) Int. Cl.[7] ..... F02P 15/00
(52) U.S. Cl. ..... 123/620; 123/169 PA; 123/654

(58) Field of Search ..... 123/169 PA, 536, 123/620, 654; 324/396

(56) References Cited

U.S. PATENT DOCUMENTS

| | | | | | |
|---|---|---|---|---|---|
| 1,441,212 | A | * | 1/1923 | Cardwell | 123/620 |
| 1,514,496 | A | * | 11/1924 | Witter | 123/169 PA |
| 1,554,252 | A | * | 9/1925 | Smith | 123/654 |
| 2,000,125 | A | * | 7/1935 | Smithson | 123/620 |
| 4,324,219 | A | * | 4/1982 | Hayashi | 123/620 |
| 4,596,222 | A | * | 6/1986 | Ortiz | 123/536 |

* cited by examiner

*Primary Examiner*—Tony M. Argenbright
(74) *Attorney, Agent, or Firm*—Jordan and Hamburg LLP

(57) ABSTRACT

A device that improves ignition spark intensity with power transmitted at the time of ignition from a conventional plug cord for an internal combustion engine to an ignition plug is constituted so that counter electromotive force arising at the time of ignition of the ignition plug is stored as electrostatic energy and is discharged at the next ignition of the ignition plug and has positive and negative electrodes, the positive electrode being connected to or in contact with an internal combustion engine plug cord and the negative electrode being connected to or in contact with an internal combustion engine ground, thereby improving ignition spark intensity.

7 Claims, 5 Drawing Sheets

PRIOR ART

PRIOR ART

IGNITION DEVICE FOR IMPROVING IGNITION SPARK INTENSITY FOR A PLUG CORD FOR AN INTERNAL COMBUSTION ENGINE AND DIRECT IGNITION SYSTEM FOR AN INTERNAL COMBUSTION ENGINE, AND METHOD FOR CONNECTING THE SAME

BACKGROUND OF INVENTION

1. Field of Invention

The present invention relates to ignition of an ignition plug or spark plug for an internal combustion engine. Its object is to improve ignition spark intensity for an ignition plug or spark plug and improve burning efficiency by providing or constituting an ignition device for a spark plug cord for an internal combustion engine and for direct ignition for an internal combustion engine.

2. Background Art

As shown in FIG. 1, with a conventional plug cord for an internal combustion engine, ignition spark intensity could not be easily improved because of a high resistance value imparted by carbon, Kevlar, or a variable pitch wire core 2, and such plug cord was given a function that worked against the function of transmitting electricity, which is the primary objective for a plug cord.

As shown in FIG. 2, in conventional direct ignition system for an internal combustion engine, in order to save space in the engine compartment, plug cords are not used, and plugs are provided with ignition coils 8, 9.

However, because of space-saving requirements, there are restrictions on size, coil capacity is restricted, and ignition spark cannot be efficiently intensified.

SUMMARY OF THE INVENTION

With the conventional art for a plug cord for an internal combustion engine, it is possible to improve ignition spark intensity by making resistance as small as one wants; however, such an ignition system causes radio frequency interference, and ignition noise can interfere with a combustion control device or audio device.

Thus a goal of the present invention is to provide an ignition device that enables ignition spark intensity to be improved without changing the voltage boosting device for an ignition plug cord for an internal combustion engine.

With the conventional art for a plug cord for an internal combustion engine, it is possible to improve ignition spark intensity by increasing voltage of supplied power; however, because plug cord length differs depending on cylinder position, this serves to promote combustion efficiency degradation caused by the unevenness of ignition spark intensity among the cylinders, improvement of which has long been a technical goal.

Thus a further goal of the present invention is to provide an ignition device that enables each cylinder to have uniform ignition spark size without changing the voltage boosting device for an ignition plug cord for an internal combustion engine.

With the conventional art for a plug cord for an internal combustion engine, it is possible to improve ignition spark intensity by increasing ignition coil capacity; however, this works against the goal of saving space and, squeezing coils into a limited space causes such problems as heating, resulting in combustion troubles.

Thus a goal of the present invention is to provide an ignition device that enables ignition spark to be intensified without changing the voltage boosting device for direction ignition for an internal combustion engine.

To meet the aforementioned goals, a first aspect of the present invention is an ignition device wherein noise at time of fuel ignition caused by a plug cord for an internal combustion engine is suppressed and ignition spark intensity is improved.

A second aspect of the present invention is an ignition device that improves ignition spark intensity in a state such that the space-related merits are taken advantage of at time of fuel ignition in direct ignition for an internal combustion engine.

A third aspect of the present invention is an ignition device according to either the first or second aspects, that improves ignition spark intensity by efficiently storing counter electromotive force as electrostatic energy and discharging the same.

A fourth aspect of the present invention is an ignition device according to the second aspect that improves ignition spark intensity by efficiently storing counter electromotive force as electrostatic energy and discharging the same.

A fifth aspect of the present invention is an ignition device enabling improvement of ignition spark intensity while improving combustion efficiency by making the ignition spark output uniform in each cylinder in a multi-cylinder internal combustion engine.

A sixth aspect of the present invention enables improvement of ignition spark intensity through use of a plurality of ignition devices in an internal combustion engine.

A seventh of the present invention enables further improvement of ignition spark intensity by efficiently storing counter electromotive force as electrostatic energy and discharging the same.

DESCRIPTION OF THE PREFERRED EMBODIMENTS

Embodiments of the present invention will be explained with reference made to the drawings.

Figure 1:
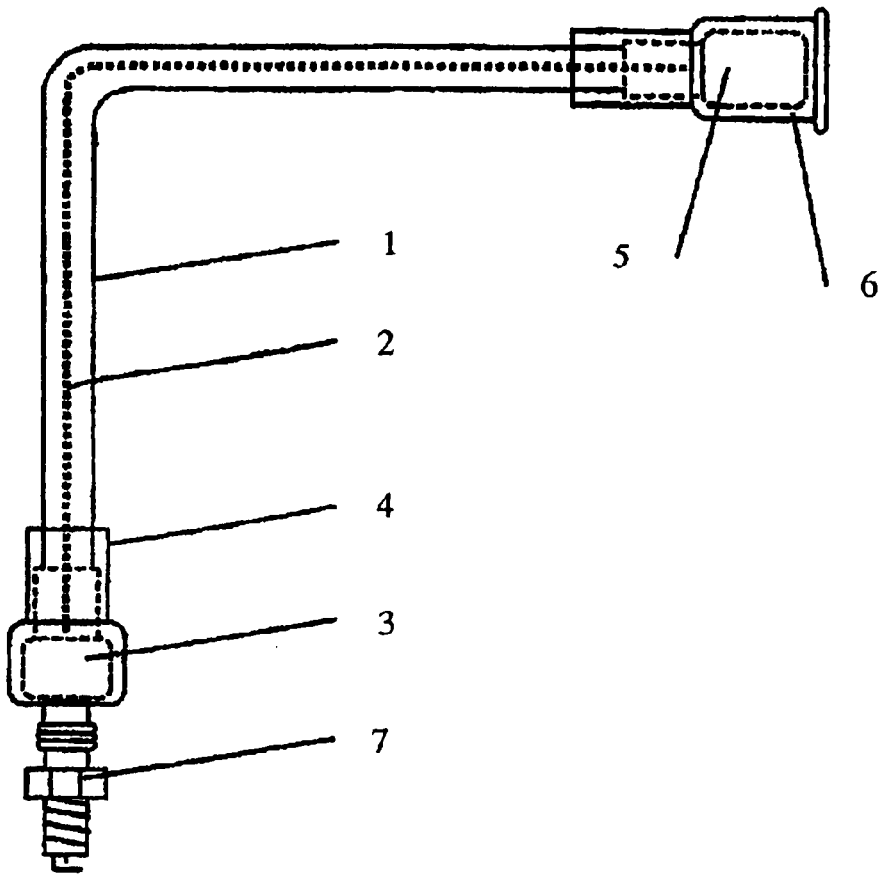
FIG. 1 is a lateral view showing a simplified full aspect of a conventional plug cord for an internal combustion engine, as well as the main components thereof.
Figure 2:
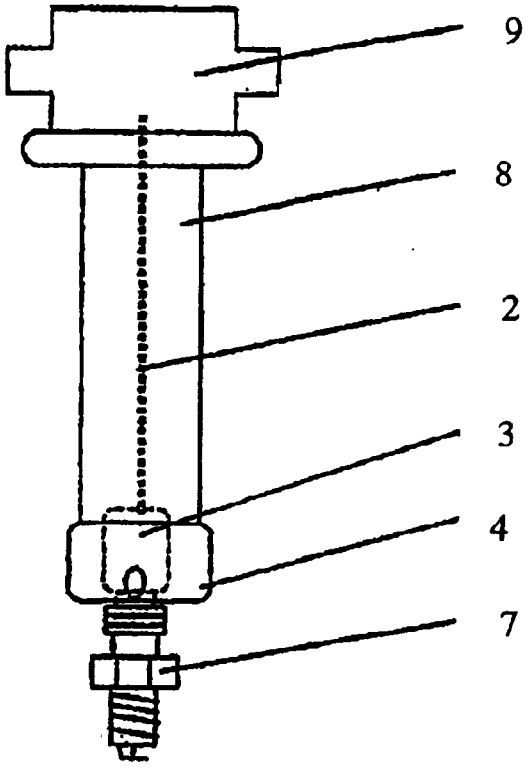
FIG. 2 is a lateral view showing a simplified full aspect of a conventional direct ignition system for an internal combustion engine, as well as the main components thereof.
Figure 3:
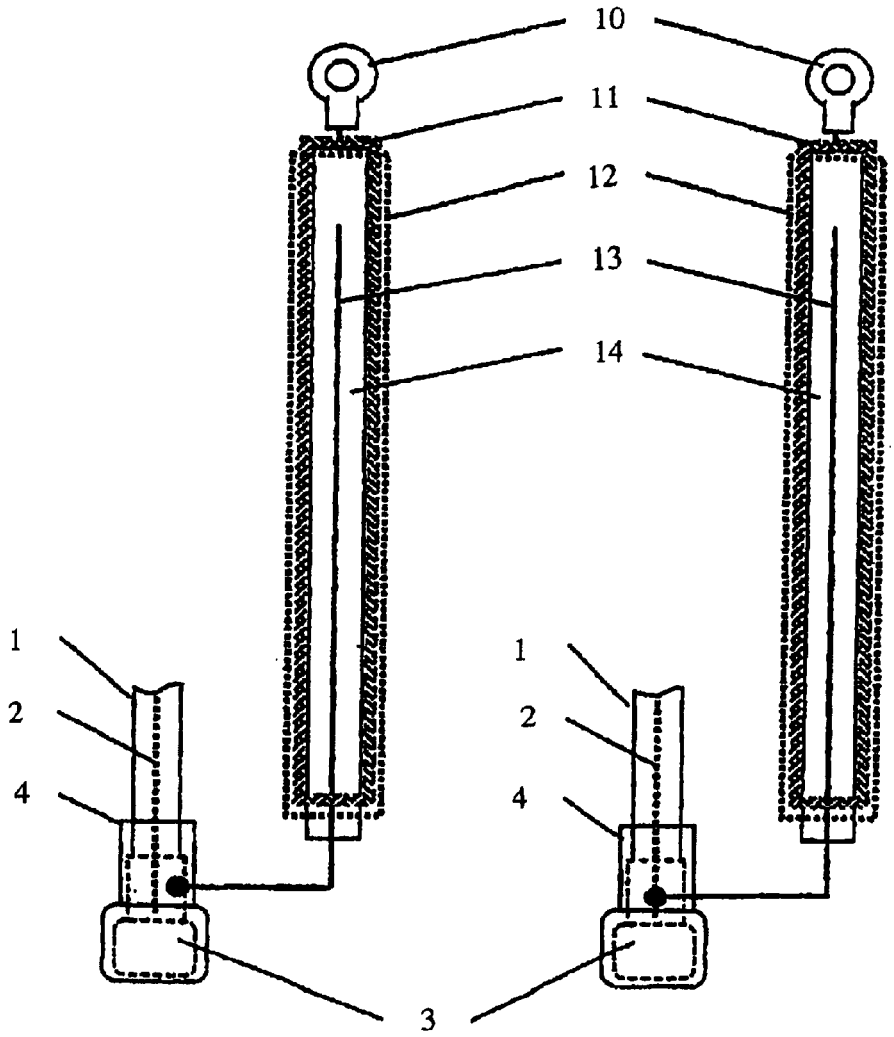
FIG. 3 is a lateral view showing a simplified full aspect of an embodiment of the present invention, as well as the main parts thereof, as used in a plug cord for an internal combustion engine.

FIG. 3 shows a first embodiment of the present invention which comprises an internal combustion engine plug cord body 1. From an ignition plug attachment hardware 3, an anode 13 extends so as to be connected thereto or to be in contact therewith. This anode 13 is covered with an insulating material 14, and is further covered with a cathode 11, and is still further covered with an insulating body 12. Thereafter, a terminal 10 is attached to a tip of the cathode 11. The terminal is connected to, or comes in contact with, an internal combustion engine ground.

In accordance with this embodiment, the ignition spark intensity is improved through the workings of the anode 13, insulating material 14, cathode 11, insulating body 12 and terminal 10. In addition, by changing the length or resistance of the resistor anode 13, the ignition spark intensity for each cylinder can be made uniform. Accordingly, this improves internal combustion engine combustion efficiency and leads to reduction of exhaust gases.

Figure 4:
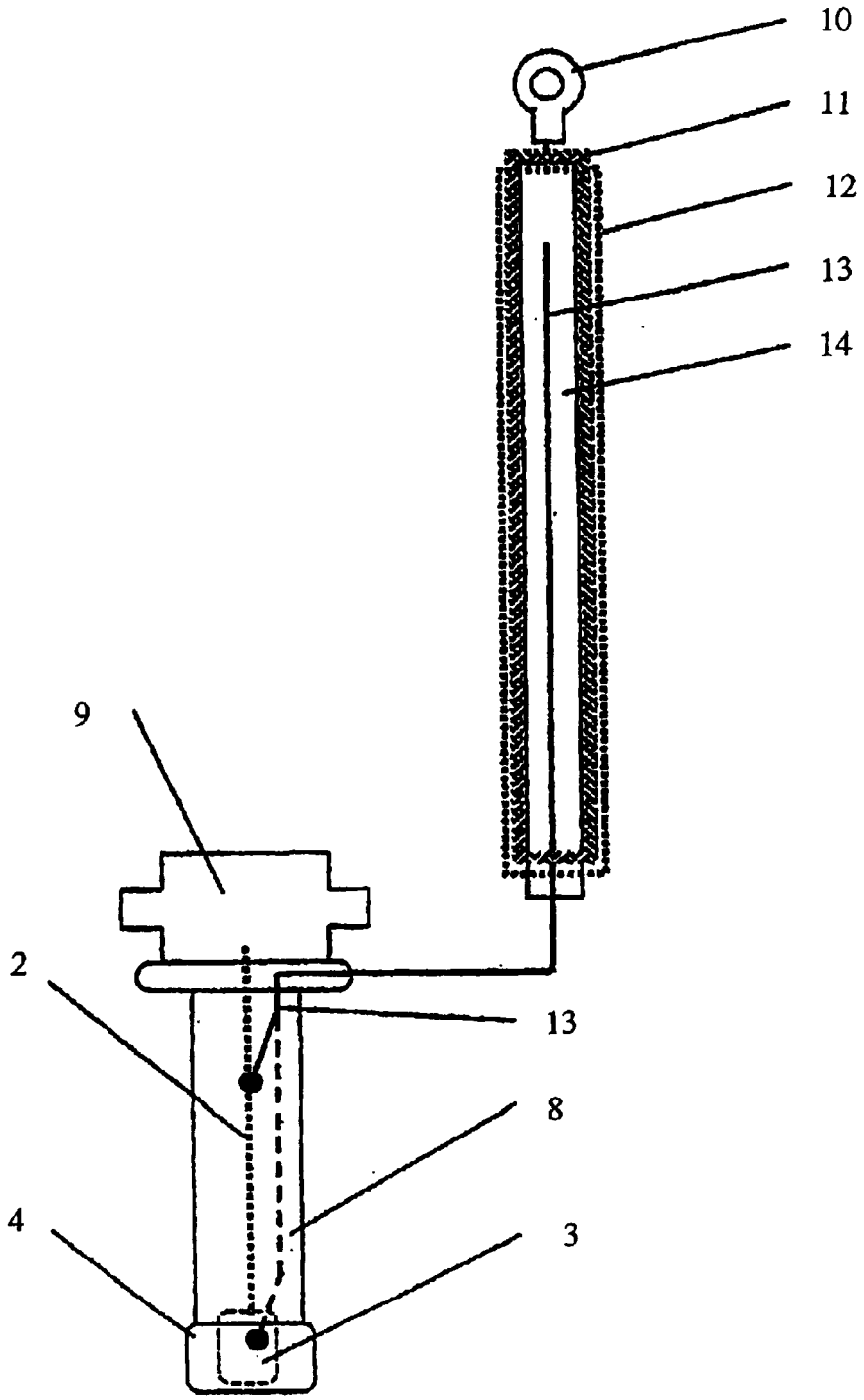
FIG. 4 is a lateral view showing a simplified full aspect of an embodiment of the present invention, as well as the main parts thereof, as used in a direct ignition system for an internal combustion engine.

FIG. 4 shows another embodiment of the present invention which comprises an internal combustion engine direct ignition system main body 2, 3, 8, 9, 13. From an ignition plug attachment hardware 3, an anode 13 extends so as to be connected thereto or to be in contact therewith. This anode 13 is covered with an insulating material 14, and is further covered with a cathode 11, and is still further covered with an insulating body 12. Thereafter, a terminal 10 is attached to a tip of the cathode 11. The terminal is connected to, or comes in contact with, an internal combustion engine ground.

In accordance with this embodiment, ignition spark intensity is improved through the workings of the anode 13, insulating material 14, cathode 11, insulating body 12 and terminal 10. Accordingly, this improves internal combustion engine combustion efficiency and leads to reduction of exhaust gases.

Figure 5:
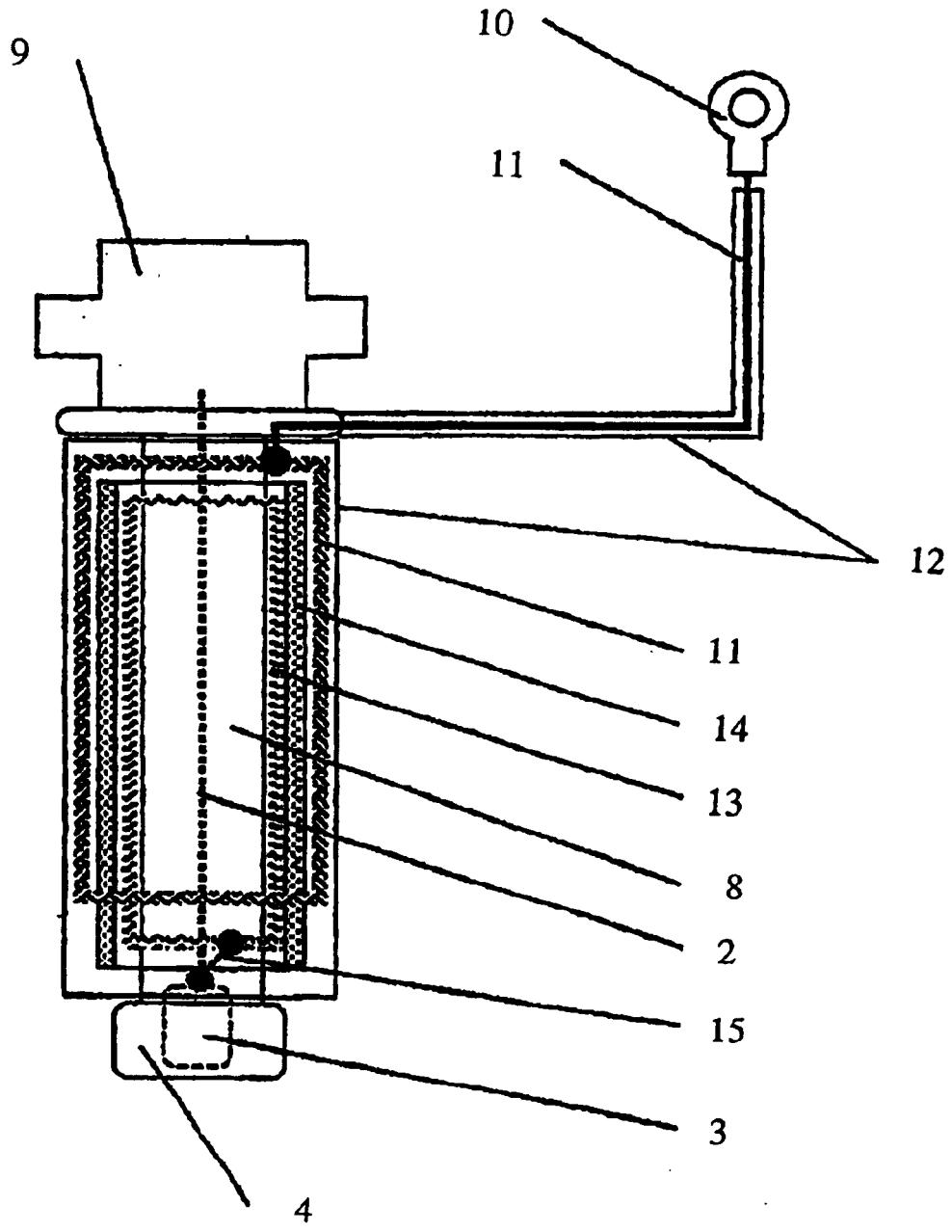
FIG. 5 is a lateral view showing a simplified full aspect of an embodiment of the present invention, as well as the main parts thereof, as used in a direct ignition system for an internal combustion engine.

FIG. 5 shows another embodiment of the present invention which comprises an internal combustion engine direct ignition system main body 2, 3, 8, 9, 13. From an ignition plug attachment hardware 3, an anode 13 is connected or is in contact with a connection part 15, and covers an ignition coil B. This anode 13 is covered with an insulating material 14, and is further covered with a cathode 11, and is still further covered with an insulating body 12. Thereafter, a terminal 10 is attached to a tip of the cathode 11. The terminal is connected to, or comes in contact with, an internal combustion engine ground.

In accordance with this embodiment, ignition spark intensity is improved through the workings of the anode 13, insulating material 14, cathode 11, insulating body 12 and terminal 10. Accordingly, this improves internal combustion engine combustion efficiency and leads to reduction of exhaust gases.

In the embodiments of FIGS. 3, 4 and 5, the ignition spark intensity is improved through the workings of the anode 13, insulating material 14, cathode 11, insulating body 12 and terminal 10. Alternatively, connection to or contact with the anode 13 may be made at an intermediate point of the ignition plug attachment hardware 3 or the core wire 2.

As described above, the present invention enables ignition spark intensity to be improved without changing a voltage boosting device for a plug cord for an internal combustion engine or direct ignition for an internal combustion engine.

Explanation of the Numerals

1, plug cord; 2, core wire; 3, ignition plug attachment hardware; 4, plug cap; 5, distributor connection hardware; 6, cap; 7, spark plug; 8, ignition coil B; 9, ignition coil A; 10, terminal; 11, cathode; 12, insulating body; 13, anode; 14, insulating material; 15, connecting part.

Accordingly, in a first embodiment (FIG. 3), a device has been disclosed that improves ignition spark intensity with power transmitted at the time of ignition from a conventional plug cord 1 for an internal combustion engine to an ignition plug 3. The device is constituted so that counter electromotive force arising at the time of ignition of the ignition plug 3 is stored as electrostatic energy and is discharged at the next ignition of the ignition plug 3 and having positive and negative electrodes 13 and 11. The positive electrode 13 being connected to or in contact with an internal combustion engine plug cord 1 and the negative electrode 11 being connected to or in contact with an internal combustion engine ground 10, thereby improving ignition spark intensity.

The device of the first embodiment is constituted so that the positive electrode 13 comprises a conductive wire made from a conductive material or a material having electrical resistance. The periphery thereof being covered with an insulating material 14, the periphery of which being further covered with a conductive material or a material having electrical resistance, so as to constitute a negative electrode 11, the outer periphery of which being covered with an insulating body 12. The device comprising an electrode end part for causing the positive electrode 13 to connect to or come in contact with an ignition plug cord 2 and an electrode end part for causing the negative electrode 11 to connect to or come in contact with an internal combustion engine ground 10.

Furthermore, in a second embedment (FIG. 4), a device is disclosed that improves ignition spark intensity with power transmitted at the time of ignition from direct ignition for an internal combustion engine to an ignition plug 3. The device is constituted so that the counter electromotive force arising at the time of ignition of the ignition plug is stored as electrostatic energy and is discharged at the next ignition of the ignition plug and having positive and negative electrodes 13 and 11. The positive electrode 13 being connected to or in contact with an internal combustion engine plug cord 1 and the negative electrode 11 being connected to or in contact with an internal combustion engine ground 10, thereby improving ignition spark intensity.

The device of the second embodiment is constituted so that the positive electrode 13 comprises a conductive wire made from a conductive material or a material having electrical resistance. The periphery thereof being covered with an insulating material 14, the periphery of which being further covered with a conductive material or a material having electrical resistance, so as to constitute the negative electrode 11, the outer periphery of which being covered with an insulating body 12. The device comprising: an electrode end part for causing the positive electrode 13 to connect to or come in contact with an ignition plug cord 1 and an electrode end part for causing the negative electrode 11 to connect to or come in contact with an internal combustion engine ground 10.

The device of the second embodiment is further constituted so that the positive electrode 13 comprises a conductive wire made from a conductive material or a material having electrical resistance around the outer periphery, or a portion thereof, of a case covering a plug terminal part from a coil constituting a conventional internal combustion engine direct ignition. The outer periphery thereof or a part thereof being covered with an insulating material, the outer periphery of which, or a part thereof, being covered with a conductive material or a material having electrical resistance, thus constituting a negative electrode 11, and the outer surface thereof, or a part thereof, being further covered with an insulating material 12. The device comprising an electrode end part for causing the positive electrode 13 to connect to or come in contact with an ignition plug cord 2 and an electrode end part for causing the negative electrode 11 to connect to or come in contact with an internal combustion engine ground 10.

More generally, an ignition device is disclosed, wherein the capacity for storing electrostatic energy appropriate for an internal combustion engine can be easily adjusted through combinations of a conductive material or a material having electrical resistance constituting a positive electrode 13, a conductive material or a material having electrical resistance constituting a negative electrode 11, and an insulating material between the positive and negative electrodes 14, and through combinations of the thickness, length and width of such materials.

In a third embodiment (FIG. 5), a connection for an ignition device is disclosed, wherein a positive electrode 13 is connected with a connector plate 15 to, or brought in contact with, a plug terminal, conductive wire 3 or resistor conductive wire 3 of a plug cord for internal combustion engine or direct ignition for an internal combustion engine. A negative electrode is connected to or brought into contact with an internal combustion engine ground 10.

What I claim is:

1. An ignition device configuration comprising:

a conventional ignition plug, said plug having a cord;

an internal combustion engine ground, said ground being separate from said plug;

a body, said body being detached from said ignition plug and said ground;

a positive electrode, said positive electrode being disposed within said body and connected to said plug cord; and a negative electrode, said negative electrode surrounding said positive electrode, being substantially disposed within said body, extending from said body, and being connected to said ground.

2. The ignition device of claim 1 wherein:

said positive electrode comprises a conductive wire, said negative electrode comprises a conductive material surrounding said positive electrode;

said ignition device further comprises:

a first insulating material, said first insulation material being disposed between said positive and negative electrodes;

a second insulating material, said second insulation material surrounding said negative electrode;

a first electrode end part, said first electric end part connecting said positive electrode to said ignition plug cord; and a second electrode end part, said second electrode end part connecting said negative electrode to said internal combustion engine ground.

3. An ignition device configuration comprising:

a direct ignition plug, said plug having a cord;

an internal combustion engine ground, said ground being separate from said cord and said ground;

a body, said body being detached from said ignition plug;

a positive electrode, said positive electrode being disposed within said body and being connected to said plug cord; and a negative electrode, said negative electrode surrounding said positive electrode, being substantially disposed within said body, extending from said body, and being connected to said ground.

4. The ignition device of claim 3 wherein:

said positive electrode comprises a conductive wire;

said negative electrode comprises a conductive material surrounding said positive electrode;

said ignition device further comprises:

a first insulating material, said first insulating material being disposed between said positive and negative electrodes;

a second insulating material, said second insulating material surrounding said negative electrode;

a first electrode end part, said first electrical end part connecting said positive electrode to said ignition plug cord; and a second electrode end part, said second electrical end part connecting said negative electrode to said internal combustion engine ground.

5. The ignition device of claim 3 wherein:

said direct ignition plug has an ignition coil and a cover;

said positive electrode comprises a conductive wire, said positive electrode being connected to said ignition coil through said cover;

said negative electrode comprises a conductive material surrounding said positive electrode;

said ignition device further comprises:

a first insulating material, said first insulating material being disposed between said positive and negative electrodes;

a second insulating material, said second insulating material surrounding said negative electrode;

a first electrode end part, said first electrode end part connecting said positive electrode to said ignition plug cord; and a second electrode end part, said second electrode end part connecting said negative electrode to said internal combustion engine ground.

6. A method of adjusting capacity for storing electrostatic energy in an internal combustion engine comprising:

obtaining an ignition plug;

obtaining an internal combustion engine ground, said ground being separate from said plug;

obtaining a body, said body being separate from said ignition plug and said ground;

locating a positive electrode within said body, said positive electrode extending from said body for connecting with said plug, said positive electrode having a predetermined thickness, length and width;

locating a negative electrode substantially within said body, said negative electrode extending from said body for connecting with said ground, said negative electrode having a predetermined thickness, length and width;

separating said positive and negative electrodes with an insulating material;

connecting said positive electrode to said ignition plug; and connecting said negative electrode to said ground.

7. An ignition device configuration comprising:

an ignition plug, said plug having a core wire;

an internal combustion engine ground, said ground being separate from said plug;

a body, said body being separate from said ground;

a positive electrode, said positive electrode being located within said body;

a connector plate, said connector plate connecting said positive electrode to said core wire; and a negative electrode, said negative electrode being located substantially within said body, extending from said body, and being connected to said external combustion engine ground.

* * * * *